US010156330B2

(12) United States Patent
Lu et al.

(10) Patent No.: US 10,156,330 B2
(45) Date of Patent: Dec. 18, 2018

(54) LED CEILING LAMP

(71) Applicant: Xiamen PVTECH Co., Ltd., Xiamen, Fujian (CN)

(72) Inventors: Fuxing Lu, Fijian (CN); Ruicha Lai, Fujian (CN); Zhirong Lin, Fujian (CN)

(73) Assignee: Xiamen PVTECH Co., Ltd., Xiamen, Fujian (CN)

( * ) Notice: Subject to any disclaimer, the term of this patent is extended or adjusted under 35 U.S.C. 154(b) by 0 days.

(21) Appl. No.: 15/721,963

(22) Filed: Oct. 2, 2017

(65) Prior Publication Data

US 2018/0112841 A1 Apr. 26, 2018

(30) Foreign Application Priority Data

Oct. 21, 2016 (CN) ..... 2016 1 0918474

(51) Int. Cl.

| | |
|---|---|
| ***F21S 8/00*** | (2006.01) |
| ***F21S 8/04*** | (2006.01) |
| ***F21V 15/01*** | (2006.01) |
| ***F21V 19/00*** | (2006.01) |
| ***F21V 21/088*** | (2006.01) |

(Continued)

(52) U.S. Cl.

CPC ..... *F21S 8/04* (2013.01); *F21V 15/01* (2013.01); *F21V 17/16* (2013.01); *F21V 19/003* (2013.01); *F21V 21/025* (2013.01); *F21V 21/03* (2013.01); *F21V 21/088* (2013.01); *F21V 15/013* (2013.01); *F21V 15/015* (2013.01); *F21V 23/008* (2013.01); *F21V 23/023* (2013.01);

(Continued)

(58) Field of Classification Search

CPC ..... F21Y 2115/10; F21Y 2103/10; F21Y 2105/10; F21Y 2101/00; F21Y 2103/20; F21Y 2113/13; F21V 15/01; F21V 19/003; F21V 15/013; F21V 15/015; F21V 17/104; F21V 17/164; F21V 19/001; F21V 19/0045; F21V 19/02; F21V 19/04; F21V 21/088; F21V 21/096; F21V 21/30; F21V 23/007

USPC ..... 362/147

See application file for complete search history.

(56) References Cited

U.S. PATENT DOCUMENTS

| | | | | |
|---|---|---|---|---|
| 3,596,425 A * | 8/1971 | Kodaras | ..... | E04B 9/008 403/201 |
| 2010/0246181 A1* | 9/2010 | Fang | ..... | F21V 19/02 362/257 |

(Continued)

FOREIGN PATENT DOCUMENTS

| | | |
|---|---|---|
| JP | 2011-96658 A | 5/2011 |
| JP | 2012-54005 A | 3/2012 |

*Primary Examiner* — Thien M Le

(74) *Attorney, Agent, or Firm* — Winston Hsu

(57) ABSTRACT

A LED ceiling lamp is provided. The LED ceiling lamp includes a lamp base including a metal frame with a mountain shaped cross section, the accommodating slot is formed through two ends of the lamp base; a power module configured in the accommodating slot of the lamp base; a plurality of first fixing units fixed at a bottom wall of the accommodating slot of the lamp base at intervals; a movable lamp light detachably assembled into the accommodating slot of the lamp base; and a plurality of second fixing units fixed to the heat dissipation unit at intervals. With the configuration of the first fixing units and the second fixing units, the movable lamp light can be fixed to or detached from the lamp base quickly. As a result, it is much more convenient.

9 Claims, 6 Drawing Sheets

(51) Int. Cl.

| | |
|---|---|
| ***F21V 17/16*** | (2006.01) |
| ***F21V 21/02*** | (2006.01) |
| ***F21V 21/03*** | (2006.01) |
| *F21Y 103/20* | (2016.01) |
| *F21V 15/015* | (2006.01) |
| *F21V 23/00* | (2015.01) |
| *F21V 23/02* | (2006.01) |
| *F21Y 103/10* | (2016.01) |
| *F21Y 115/10* | (2016.01) |

(52) U.S. Cl.
CPC ..... *F21Y 2103/10* (2016.08); *F21Y 2103/20* (2016.08); *F21Y 2115/10* (2016.08)

(56) References Cited

U.S. PATENT DOCUMENTS

2011/0286207 A1* 11/2011 Chan ..... F21V 15/013 362/217.1
2014/0347849 A1* 11/2014 Xu ..... F21V 23/007 362/217.17
2015/0003053 A1* 1/2015 Ariyoshi ..... F21V 23/0471 362/223
2016/0061410 A1* 3/2016 Jung ..... G02B 19/0066 362/334
2017/0356606 A1* 12/2017 Rashidi Doust ..... F21S 8/06

* cited by examiner

LED CEILING LAMP

BACKGROUND OF THE INVENTION

1. Field of the Invention

The invention relates to a Light Emitting Diode (LED) ceiling lamp and, more particularly, to a LED lamp which is easily assembled onto or detached from a lamp base.

2. Description of the Prior Art

With the development of LED in recent years, white LEDs are launched, and LEDs becomes popular and has great potential. LED has lots of advantages, such as environmental protection, electricity saving, high efficiency and long service life, small in size, fast in reaction and the like. As a result, to overcome the defects of the fluorescent tube and meet the requirements on the environmental protection, energy conservation, and emission reduction, LED tubes are developed to replace conventional fluorescent tubes. LED lamps are gradually used in various lighting fields. The Led lighting technology is regarded as a welcome light source in the 21 century. The Led lighting sources may replace conventional light sources and becomes to a mainstream illumination light source.

Please refer to FIG. 1 and FIG. 2, conventionally, a lamp includes a mountain-shaped ceiling lamp base 90 and a movable lamp 80. The movable lamp 80 is detachable from the mountain-shaped ceiling lamp base 90. The mountain-shaped ceiling lamp base 90 includes an assembling slot 1011 for accommodating the movable lamp 80 therein.

However, since the movable lamp 80 has some weight, the mountain-shaped ceiling lamp base 90 is configured with a fixing member 91 of particular specification to fix the movable lamp 80. However, it is not easily to detach the movable lamp 80 via the fixing member 91.

SUMMARY OF THE INVENTION

A LED ceiling lamp is provided. The LED ceiling lamp, comprising: a lamp base including a metal frame with a mountain shaped cross section, the accommodating slot is formed through two ends of the lamp base; a power module configured in the accommodating slot of the lamp base; a plurality of first fixing units fixed at a bottom wall of the accommodating slot of the lamp base at intervals, the first fixing unit includes an accommodating slot, and the accommodating slot is perpendicular to the bottom wall of the accommodating slot; a movable lamp light detachably assembled into the accommodating slot of the lamp base, wherein the movable lamp light includes a heat dissipation unit, a LED panel, a lamp cover and two end plates, an shape of the heat dissipation unit corresponds to the shape of the accommodating slot to make shape adapted to be accommodated in the accommodating slot, the LED panel corresponds to the heat dissipation unit, a shape of the lamp cover corresponds to the shape of the heat dissipation unit, the lamp cover is detachably fixed to the heat dissipation unit and covers a light emitting side of the LED panel, the end plates seal two openings of a tube-shaped structure formed by the heat dissipation unit and the lamp cover, a hole is formed at each of the cover plates, a seal cover is detachably assembled from the hole; and a plurality of second fixing units fixed to the heat dissipation unit at intervals, the positions of the second fixing units correspond to the positions of the first fixing units 30, respectively, the second fixing units are detachably fixed with the first fixing units, the second fixing unit includes an inserting member adapted to be inserted into the accommodating slot.

In an embodiment, the accommodating slot has a rectangle cross section.

In an embodiment, cover plates are configured at two ends of the lamp base, the cover plate seal two ends of the accommodating slot, and the cover plates are flushed and contact with the cover plates.

In an embodiment, the accommodating slot is formed by two clip sheets facing each other, middle portions of the two clip sheets protrude towards each other to form a clip portion, the inserting member includes a protrusion portion, and when the inserting member is inserted into the accommodating slot, the protrusion portion is held by the clip portion.

In an embodiment, the clip sheets are elastic clip sheets.

In an embodiment, the LED ceiling lamp includes a plurality of safety rope fasteners fixed to the heat dissipation unit correspondingly.

In an embodiment, the lamp cover is made of light-transmitting plastic profile extrusion, and the lamp cover has an arc-shaped section.

In an embodiment, a first matching structure is configured at an edge of a side wall of the cover plate, a second matching structure is configured at the end plate corresponding to the side wall of the cover plate, the shape of the second matching structure matches the shape of the first matching structure, and the end plate are connected with the cover plate seamlessly.

In an embodiment, the lamp base includes a body and two flanks, and the body and the flank are made of aluminum profile extrusion.

In an embodiment, assembling slots are formed at two side walls of the body, connection portions are configured at walls where the flanks are connected with the body, and the connection portions are fastened into the assembling slot when the connection portions get in the assembling slot.

In embodiments of the LED ceiling lamp, the first fixing units and the second fixing units are configured at the bottom wall of the accommodating slot of the lamp base and the heat dissipation unit of the movable lamp light, respectively. The first fixing units and the second fixing units can be fixed together quickly when inserted together. Consequently, the movable lamp light can be fixed to or detached from the lamp base quickly. As a result, it is much more convenient.

BRIEF DESCRIPTION OF THE DRAWINGS

These and other features, aspects and advantages of the invention will become better understood with regard to the following embodiments and accompanying drawings.

DETAILED DESCRIPTION

Figure 1:
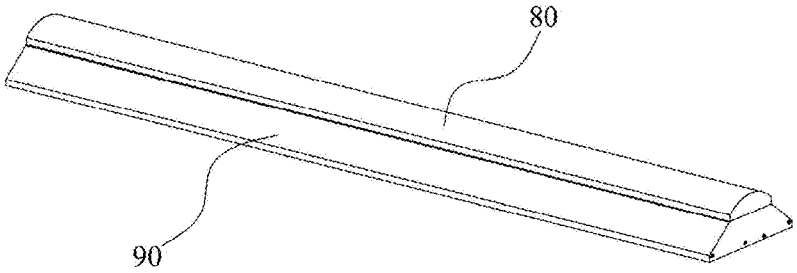
FIG. 1 is a schematic diagram showing a conventional LED ceiling lamp.
Figure 2:
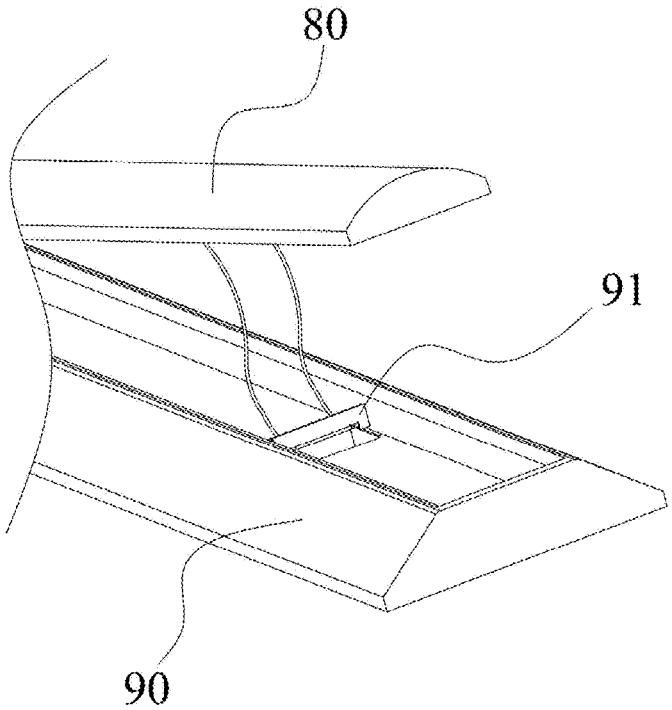
FIG. 2 is a schematic diagram showing a conventional LED ceiling lamp.
Figure 3:
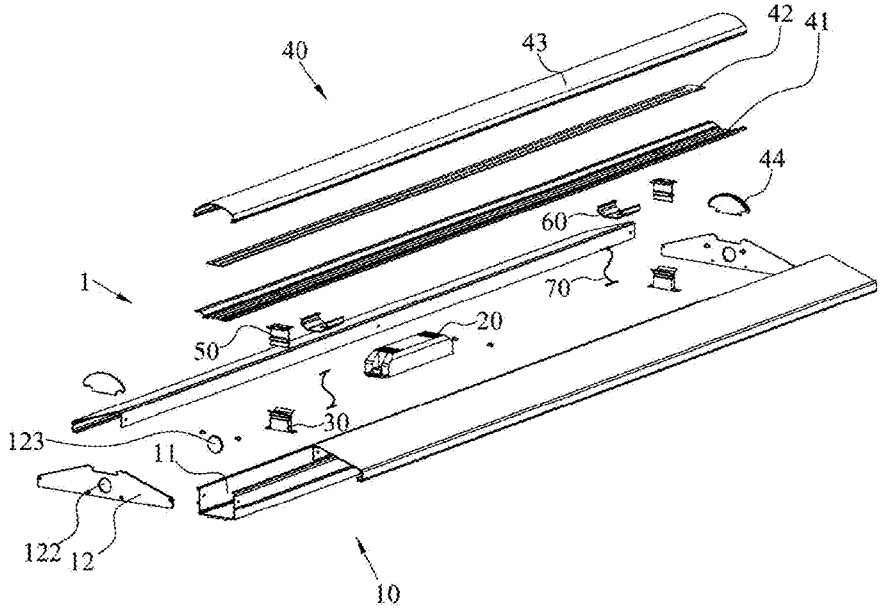
FIG. 3 is an exploded view showing a LED ceiling lamp in an embodiment.
Figure 4:
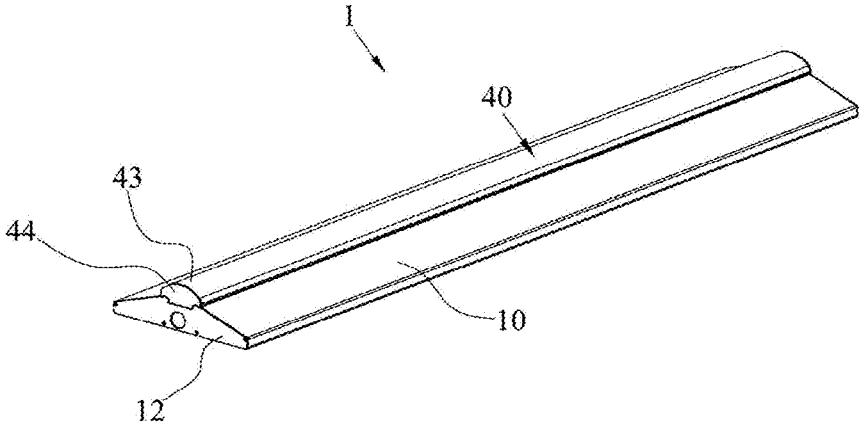
FIG. 4 is a schematic diagram showing an outlook of a LED ceiling lamp in an embodiment.

FIG. 3 is an exploded view showing a LED ceiling lamp in an embodiment. Please refer to FIG. 3 and FIG. 4, a the LED ceiling lamp 1 includes a lamp base 10, a power module 20, a plurality of first fixing units 30, a movable lamp light 40, a plurality of second fixing units 50 and a plurality of safety rope fasteners 60.

The lamp base 10 is a metal frame with a mountain shaped cross section. An accommodating slot 11 is formed through two ends of the lamp base 10. In an embodiment, the accommodating slot 11 has a rectangle cross section. Two cover plates 12 are configured at two ends of the lamp base 10, respectively. The cover plates 12 seal two ends of the accommodating slot 11. A hole 122 is formed at each of the cover plates 12, respectively. Seal covers 123 are detachably assembled from the holes 122, respectively.

The power module 20 is configured in the accommodating slot 11 of the lamp base 10 for the power supply.

Figure 5:
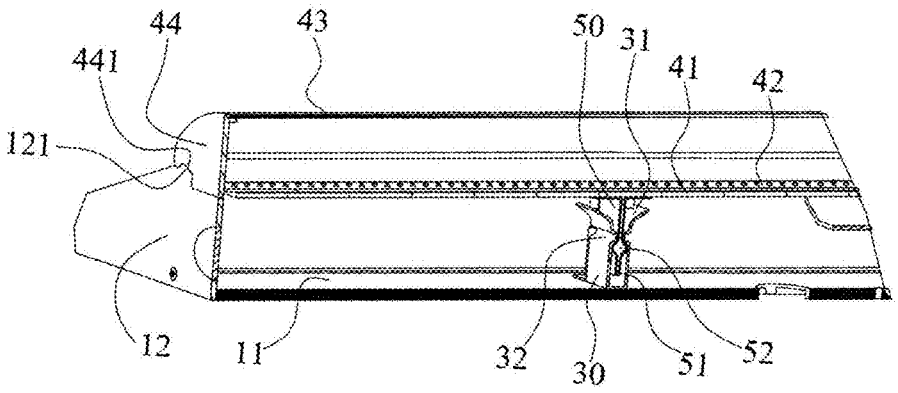
FIG. 5 is a section view of part of components of a LED ceiling lamp in an embodiment.
Figure 6:
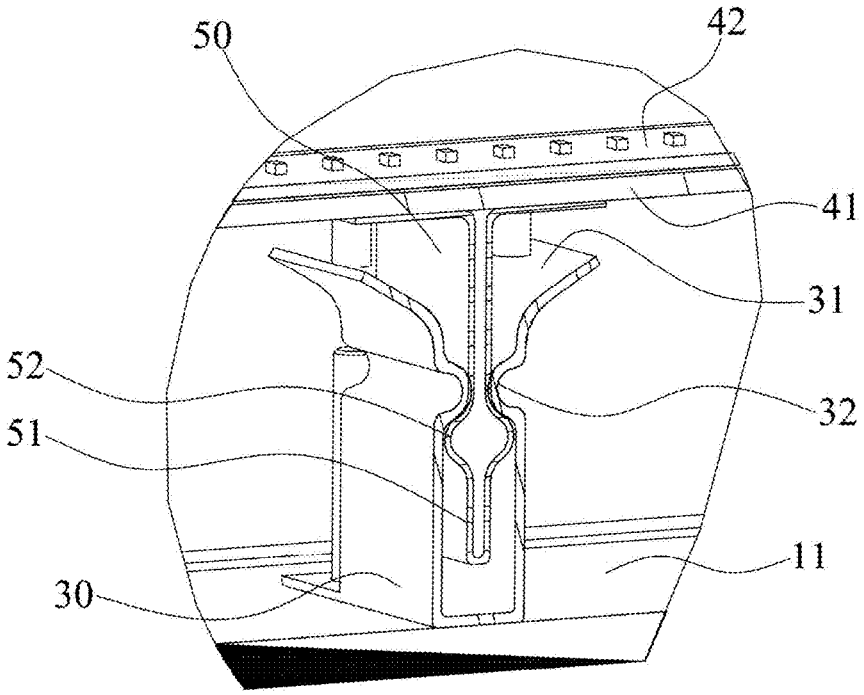
FIG. 6 is a section view of part of components of a LED ceiling lamp in an embodiment.

FIG. 5 is a section view of part of components of a LED ceiling lamp in an embodiment. FIG. 6 is a section view of part of components of a LED ceiling lamp in an embodiment. Please refer to FIG. 5 and FIG. 6, the first fixing units 30 are fixed at a bottom wall of the accommodating slot 11 of the lamp base 10 at intervals. The first fixing unit 30 includes an accommodating slot 31. The accommodating slot 31 is perpendicular to the bottom wall of the accommodating slot 11. The accommodating slot 31 is formed by two clip sheets facing each other. In an embodiment, the two clip sheets are elastic clip sheets. Middle portions of the two clip sheets protrude towards each other to form a clip portion 32 with narrow width between the two clip sheets.

The movable lamp light 40 is detachably assembled into the accommodating slot 11 of the lamp base 10. The movable lamp light 40 includes a heat dissipation unit 41, a LED panel 42, a lamp cover 43 and two end plates 44.

The shape of the heat dissipation unit 41 corresponds to that of the accommodating slot 11. In an embodiment, the heat dissipation unit 41 is made of a metal, such as aluminum profile extrusion. The heat dissipation unit 41 is accommodated in the accommodating slot 11. The LED panel 42 is fixed to the heat dissipation unit 41. The LED panel 42 is electronically connected to the power module 20 to have power. In an embodiment, the lamp cover 43 is made of light-transmitting plastic profile extrusion, which is not limited herein. The lamp cover 43 has an arc-shaped section. The shape of the lamp cover 43 corresponds to the shape of the heat dissipation unit 41. The lamp cover 43 is detachably fixed to the heat dissipation unit 41 and covers a light emitting side of the LED panel 42. The end plates 44 seal two openings of a tube-shaped structure formed by the heat dissipation unit 41 and the lamp cover 43. The end plates 44 are flushed and contact with the cover plates 12.

The second fixing units 50 are fixed to the heat dissipation unit 41 at intervals. The positions of the second fixing units 50 correspond to the positions of the first fixing units 30, respectively. The second fixing units 50 are detachably fixed with the first fixing units 30, respectively. The second fixing unit 50 includes an inserting member 51 which is adapted to be inserted into the accommodating slot 31. The inserting member 51 includes a protrusion portion 52. When the inserting member 51 is inserted into the accommodating slot 31, the protrusion portion 52 is held by the clip portion 32, which is convenient.

The safety rope fastener 60 is fixed to the heat dissipation unit 41. The safety rope fastener 60 is configured for a safety rope 70 passing through.

As shown in FIG. 5, a first matching structure 121 is configured at an edge of the side wall of the cover plate 12. A second matching structure 441 is configured at the end plate 44 corresponding to the side wall of the cover plate 12. The shape of the second matching structure 441 matches that of the first matching structure 121. As a result, the end plate 44 and the cover plate 12 are connected seamlessly.

Figure 7:
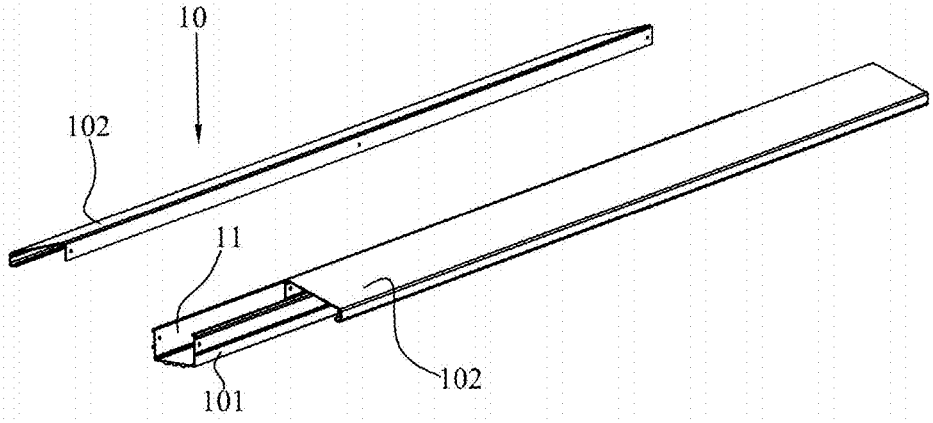
FIG. 7 is an exploded view showing part components of a LED ceiling lamp in an embodiment.
Figure 8:
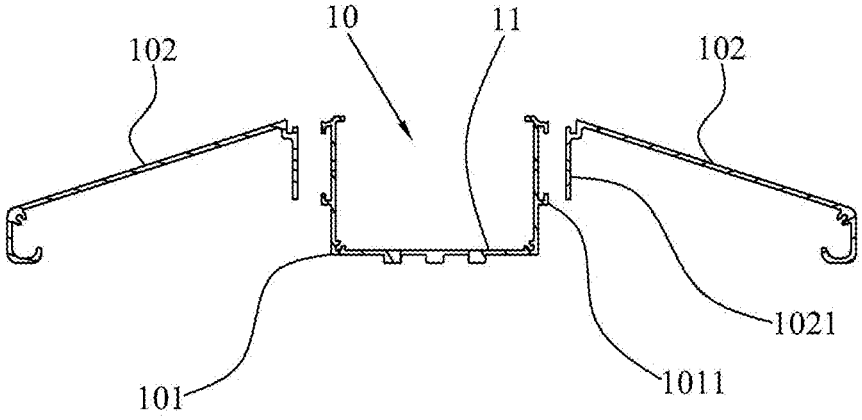
FIG. 8 is an exploded view showing part components of a LED ceiling lamp in an embodiment.

FIG. 7 is an exploded view showing part components of a LED ceiling lamp in an embodiment. FIG. 8 is an exploded view showing part components of a LED ceiling lamp in an embodiment. Please refer to FIG. 7 and FIG. 8, the lamp base 10 further includes a body 101 and two flanks 102. In an embodiment, the body 101 is a long groove structure with three walls. In an embodiment, the body 101 is made of aluminum profile extrusion, which is not limited herein. Assembling slots 1011 are formed at two side walls of the walls of the body 10. The flanks 102 are connected with two side walls of the body 101. In an embodiment, the flanks 102 are made of aluminum profile extrusion, which is not limited herein. In an embodiment, connection portions 1021 are configured at walls where the flanks 102 are connected with the body 101. The connection portions 1021 are fastened into the assembling slot 1011 when the connection portions 1021 get in the assembling slot 1011.

In embodiments of the LED ceiling lamp, the first fixing units 30 and the second fixing units 50 are configured at the bottom wall of the accommodating slot 11 of the lamp base 10 and the heat dissipation unit 41 of the movable lamp light 40, respectively. The first fixing units 30 and the second fixing units 50 can be fixed together quickly when inserted together. Consequently, the movable lamp light 40 can be fixed to or detached from the lamp base 10 quickly. As a result, it is much more convenient.

In an embodiment, the lamp base 10 is made of aluminum profile extrusion. In comparison with bended steel plates, the lamp can be made longer, the surface of the lamp base is smoother, the heat dissipation effect is improved, the outer surface is optimized, and the strength is higher. Furthermore, with seamless connection, the lamp base has beautiful appearance, and the quality of the lamp looks better.

Although the invention has been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. A Light Emitting Diode (LED) ceiling lamp, comprising:

a lamp base including a metal frame with a mountain shaped cross section, the accommodating slot is formed through two ends of the lamp base;

a power module configured in the accommodating slot of the lamp base;

a plurality of first fixing units fixed at a bottom wall of the accommodating slot of the lamp base at intervals, the first fixing unit includes an accommodating slot, and the accommodating slot is perpendicular to the bottom wall of the accommodating slot;

a movable lamp light detachably assembled into the accommodating slot of the lamp base, wherein the movable lamp light includes a heat dissipation unit, a LED panel, a lamp cover and two end plates, a shape of the heat dissipation unit corresponds to the shape of the accommodating slot to make the heat dissipation unit adapted to be accommodated in the accommodating slot, the LED panel corresponds to the heat dissipation unit, the shape of the lamp cover corresponds to the shape of the heat dissipation unit, the lamp cover is detachably fixed to the heat dissipation unit and covers a light emitting side of the LED panel, the end plates seal two openings of a tube-shaped structure formed by the heat dissipation unit and the lamp cover, a hole is formed at each of the cover plates, a seal cover is detachably assembled from the hole;

a plurality of second fixing units fixed to the heat dissipation unit at intervals, positions of the second fixing units correspond to the positions of the first fixing units, respectively, the second fixing units are detachably fixed with the first fixing units, the second fixing unit includes an inserting member adapted to be inserted into the accommodating slot; and a plurality of safety rope fasteners fixed to the heat dissipation unit correspondingly.

2. The LED ceiling lamp according to claim 1, wherein the accommodating slot has a rectangle cross section.

3. The LED ceiling lamp according to claim 1, wherein cover plates are configured at two ends of the lamp base, the cover plate seal two ends of the accommodating slot, and the cover plates are flushed and contact with the cover plates.

4. The LED ceiling lamp according to claim 3, wherein a first matching structure is configured at an edge of a side wall of the cover plate, a second matching structure is configured at the end plate corresponding to the side wall of the cover plate, the shape of the second matching structure matches the shape of the first matching structure, and the end plate are connected with the cover plate seamlessly.

5. The LED ceiling lamp according to claim 1, wherein the accommodating slot is formed by two clip sheets facing each other, middle portions of the two clip sheets protrude towards each other to form a clip portion, the inserting member includes a protrusion portion, and when the inserting member is inserted into the accommodating slot, the protrusion portion is held by the clip portion.

6. The LED ceiling lamp according to claim 5, wherein the clip sheets are elastic clip sheets.

7. The LED ceiling lamp according to claim 1, wherein the lamp cover is made of light-transmitting plastic profile extrusion, and the lamp cover has an arc-shaped section.

8. The LED ceiling lamp according to claim 1, wherein the lamp base includes a body and two flanks, and the body and the flank are made of aluminum profile extrusion.

9. The LED ceiling lamp according to claim 8, wherein assembling slots are formed at two side walls of the body, connection portions are configured at walls where the flanks are connected with the body, and the connection portions are fastened into the assembling slot when the connection portions get in the assembling slot.

* * * * *